US006763987B1

(12) United States Patent
Eberle

(10) Patent No.: US 6,763,987 B1
(45) Date of Patent: Jul. 20, 2004

(54) BACKPACK WITH INCORPORATED GUN SCABBARD

(76) Inventor: Glen Richard Eberle, 2410 Hillway Dr., Boise, ID (US) 83702

( * ) Notice: Subject to any disclaimer, the term of this patent is extended or adjusted under 35 U.S.C. 154(b) by 0 days.

(21) Appl. No.: 10/355,495

(22) Filed: Jan. 31, 2003

(51) Int. Cl.[7] ..... A45F 3/04

(52) U.S. Cl. ..... 224/637; 224/652; 224/653; 224/913

(58) Field of Search ..... 224/261, 262, 224/633, 636, 637, 652, 653, 657, 913

(56) References Cited

U.S. PATENT DOCUMENTS 4,693,402 A * 9/1987 Comeau ..... 224/604
4,754,904 A * 7/1988 Fischer et al. ..... 224/913
4,756,456 A * 7/1988 Schauer ..... 224/913
D311,813 S * 11/1990 Oliver ..... D3/216
5,016,793 A * 5/1991 Derkatz ..... 224/913
5,131,576 A * 7/1992 Turnipseed ..... 224/262
5,492,255 A * 2/1996 Gansky et al. ..... 224/261
5,573,166 A * 11/1996 Leja ..... 224/652
5,603,441 A * 2/1997 Easter ..... 224/652
5,664,721 A * 9/1997 Homeyer ..... 224/913
5,669,170 A * 9/1997 Norris ..... 224/913
5,791,537 A * 8/1998 Miller ..... 224/652
5,806,742 A * 9/1998 Mott et al. ..... 224/913
6,119,907 A * 9/2000 Benjamin ..... 224/913
6,152,338 A * 11/2000 Smith ..... 224/913
6,179,188 B1 * 1/2001 Gleason ..... 224/262
6,290,114 B1 * 9/2001 Berberian ..... 224/653
6,336,576 B1 * 1/2002 Easter ..... 224/913
6,367,674 B1 * 4/2002 Tabor ..... 224/653
6,619,519 B1 * 9/2003 Nix et al. ..... 224/637

* cited by examiner

*Primary Examiner*—Gary E. Elkins

(57) ABSTRACT

A method of forming a backpack with an integral gun scabbard has been devised whereby the user has a convenient place for the storage and carriage of a rifle, shotgun, or other long gun type of firearm, and simultaneously can store and carry a variety of other sundry cargo while moving about. The backpack is devised in such a way as to permit easy and rapid access to and retrieval of said firearm from the storage. It is equipped with dual padded shoulder straps. In an ideal embodiment, a waist belt is included to facilitate the stabilization of the scabbard when the firearm is being withdrawn, as well as to contribute to the load bearing functions of the backpack.

9 Claims, 4 Drawing Sheets

BACKPACK WITH INCORPORATED GUN SCABBARD

CROSS-REFERENCE TO RELATED APPLICATION

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates to backpacks. In particular, the present invention relates to a backpack which is designed to have the dual utility of carrying a long barreled firearm as well as a load of varied cargo, and furthermore allows rapid access to and use of said firearm without removal of the backpack from the user's back. This combined capability is most useful for the activity of hunting, wherein a user will often be carrying some sort of backpack filled with the sundries necessary to the outing, and simultaneously carrying a long gun type of firearm. These latter are often fitted with a single strap or sling, which permit them to be slung over a user's shoulder in order to relieve the user's hands of a constant burden. It can readily be imagined that the shoulder straps and bulk of a backpack generally cause direct interference with the carriage of a long gun over one's shoulder. There have been some attempts to address this problem, with varying degrees of success. A common handicap in the prior art is that the mechanisms devised for attaching a firearm to a backpack generally require the removal of the backpack from the wearer's back in order to detach the firearm from its carriage. In hunting, it is frequently necessary to have quick and ready access to one's firearm, and products in the prior art do not facilitate this.

It is further presented that for purposes of safety as well as for the purpose of the protection of valuable firearms while actively hiking while hunting, it is necessary and beneficial to have the firearm enveloped in some type of protective surround whereby passing branches won't protrude into the firing mechanism of the firearm, and also won't be permitted to scratch and mar the finish of the gunstock, which is frequently made of wood.

Another obstacle in the art is that most rifles, shotguns, and other long gun firearms are of sufficient length that they are generally an encumbrance to activity regardless of where they are stowed. If they are attached to a backpack, they often will stick up too high and thereby snag overhead branches as the wearer passes under. If they are too low, they tend to bump and collide with the user's legs, or to hit logs, rocks, and the like that the user is stepping over.

There is a long history and variety of backpacks and related devices for carriage of loads upon the human back, and the prior art is widely explored, known, and developed. Their size and dimension ranges from a small, compact variety known as daypacks, such as disclosed in U.S. Pat. No. 5,573,166 to Leja, to larger packs designed for carrying heavier and more bulky loads such as disclosed in U.S. Pat. No. 6,179,188 to Gleason. Any and all of these will cause the aforementioned interference with the carriage of a long gun.

There is similarly a long and varied history of means and mechanisms for carriage of long guns, some of which include some type of backpack-based storage. Most often, a variety of straps are used to attach a gun either to a simple platform as disclosed in U.S. Pat. No. D311,813 to Oliver, U.S. Pat. No. 4,754,904 to Fischer, et al., or similar strap combinations might be used to attach a firearm to a backpack. These varieties typically require the manipulation of a number of straps both to attach and to remove the firearm from the carriage, thus being examples of devices that are not well suited to the active pursuit of game. Similar devices are disclosed in U.S. Pat. No. 5,664,721 to Homeyer, and U.S. Pat. No. 5,669,170 to Norris.

Other devices have been developed which attempt to maintain the firearm in a ready position while relieving one's hands of the constant burden of carriage, as for example disclosed in U.S. Pat. No. 6,152,338 to Smith, wherein straps and a spatula type of structure are used to support a firearm in a carriage position forward of the user's shoulders. While this device may serve to function in combination with a backpack and does place the firearm in a position of ready access, it does not provide a protective surround for the firearm. Further, if while using a device of this variety a user came across game, he would still have to unfasten one or more straps in order to have free use of his firearm. In addition, it may be felt that having the firearm positioned forward of the shoulder places it in a position of obstruction and causes interference with one's activities.

Examples in the prior art which attempt to address carriage of a long gun in a manner that either protects it or positions it out of a user's way generally do not permit the simultaneous carriage of a backpack or load other than the firearm. For instance, as disclosed in U.S. Pat. No. 5,016,793 to Derkatz, the firearm is to be housed in a standard scabbard, which has been fitted with shoulder straps for carriage. In this case, there is no provision for carriage of an additional load, such as a hunter would typically need in a day's outing, nor is the described harness sufficient to comfortably carry significant cargo. The device as disclosed could not be fitted with significant cargo carrying capacity, and further would preclude the carriage of a backpack or waist pack. Another example is disclosed in U.S. Pat. No. 5,806,742 to Mott, et al., wherein a described gun case is fitted with backpack style shoulder straps. While this device is suitable for the transportation of a firearm, it would not be suitable for active hunting, as the case is designed to be of flexible construction, which causes it not to function as a scabbard, since the flexible cloth will act as an impediment to the rapid withdrawal of the firearm. In addition, it is fitted with a cover flap and closure strap, which obviate that it is not designed for the rapid removal of the contents. Further, this device is designed without the intent of bearing a load greater than the firearm and some small associated items such as ammunition, does not provide for the storage capacity of any type of backpack, and precludes the simultaneous use of a separate backpack.

There are examples of backpacks that have been designed to carry a combination of sundries and some sort of bulky elongated article, such as disclosed in U.S. Pat. No. 4,693,402 to Comeau and U.S. Pat. No. 6,367,674 to Tabor. These are generally light duty and are not designed or apparently envisioned with the mechanical and physical attributes necessary for the carriage of a long gun type of firearm.

It can readily be appreciated that in the sport of hunting, participants frequently range far afield on foot, and often desire to carry in a backpack a range of goods necessary to the outing. These can include camping gear, survival equipment, inclement weather gear, water, and food stocks, as well as the sundries devoted to the sport of hunting. This gear and these packs can be quite bulky, and as previously shown can interfere with the traditional over-the-shoulder sling carriage of a long gun. It can further be imagined that when climbing hills, passing through thick brush, and the like, the use of both hands is desirable, and that for reasons of safety, convenience, and the relief of fatigue, it is desirable to stow one's firearm in a place that keeps it safe and out of the way, but still maintains it in a ready position in the event that one has an unexpected encounter with game.

It is submitted that the present invention substantially meets these needs, and is a new, original, and unique departure from the prior art, and that it will be embraced with enthusiasm by those avid participants in the sport of hunting who prefer to hike about on their feet.

BRIEF SUMMARY OF THE INVENTION

The present invention is a backpack which is capable of simultaneously carrying a load of miscellaneous cargo and a long gun type of firearm. A primary object of the invention is to present a backpack of true dual utility, which will be capable of carrying significant loads of cargo and which provides a solution to the problem of where to stow a long gun on one's person while one is carrying a backpack. More specifically, a backpack is presented which has two shoulder straps, which extend from the top of the pack forward over the shoulders of a user, and then return on either side of the waist to reattach at the lower part of the backpack. In the preferred embodiment, these straps are padded on their upper portion in order to make the pack more comfortable for the wearer, and are fitted with a means of making them adjustable in length. Also in the preferred embodiment, a waist belt is included for the dual purposes of adding to the load bearing capabilities of the backpack, and to stabilize the lower portion of the pack in order to facilitate the rapid withdrawal of the firearm from its housing. Preferably, this waist belt is of heavy-duty construction, is padded for comfort, is wide nearest the main panel of the backpack, and tapers in a symmetrical fashion as it develops forward toward an adjustable and releasable closure. The backpack is sized in such a manner that the whole of the primary structure, which uses a generally rectangular panel as its foundation, fits most users in a way that its bottom extent ends just above the buttocks, and the top rises to the level of the top of the user's shoulders. This latter dimension is important because it permits the user to reach over his shoulder, and to grasp and withdraw the firearm from its housing, without removing the backpack.

The storage compartments of the backpack are of two diverse types. Firstly, a scabbard is provided, which in the ideal embodiment is of semi-rigid construction to facilitate easily inserting and rapidly removing a firearm, and is a long, tapered, hollow sheath with an open top which is sized such that it fits most long gun type firearms, including scoped rifles and shotguns. One of the objects of the invention is to present a device which allows the rapid and ready retrieval of one's long gun from its storage in the event it is needed. To accomplish this, the top of the scabbard is approximately flush with the top of the main panel of the backpack, which is in turn approximately level with the top of the wearer's shoulders, thereby permitting the user to easily reach over his shoulder and grasp the butt stock or the pistol grip of the firearm for its withdrawal. It is likewise important that the scabbard be positioned with a minimum of space between it and the user's back, so that one doesn't have to reach overly far back to grasp the firearm. Of final importance in sizing the scabbard is to make it sufficient of length to house a standard long gun's barrel, sights, action, trigger assembly, and fore-stock up to the approximate position of its pistol grip, but it must not be made of such a great length that it protrudes overly far below the bottom level of the backpack in order that it not become an encumbrance to activity. In the preferred embodiment, this scabbard is fixedly attached, plan form, to the main panel of the backpack. It is oriented vertically, with the top approximately even with the top of the main panel and the bottom protruding below the bottom extent of the main panel, and fills approximately half of the lateral space of the front side of the main panel.

The second type of storage compartment is comprised of a six sided, box type construction, is made of fabric, and has an orifice with a zipper, clasp, or like closure, and is similar to conventional cargo compartments on backpacks of the prior art. In the present embodiment, a cargo compartment is fixedly attached to the front side of the main panel of the backpack, adjacent to the scabbard, and filling the remaining lateral space. In a preferred embodiment, it is of a similar thickness to the scabbard, thereby filling approximately the same volume of space above the main panel of the backpack. By constructing both the scabbard and first cargo compartment of the same thickness, a uniform layer in the backpack is formed which facilitates placing a uniformly dimensioned larger cargo compartment outside these first storage units. This larger compartment is also a six sided, sewn fabric, box type construction, with an orifice and a releasable closure therefore. In an alternative embodiment, the first storage compartment can be made of a greater depth than the scabbard, thereby giving it substantial storage volume, and the larger overlaid compartment can be foregone. It can readily be seen that all of these described standard cargo compartments may be further internally subdivided, with provision made for individual access to, and selective closure for, each of the storage cells thereby formed, without substantially altering the intent or scope of the invention. It can similarly be seen that the size and orientation of the cargo compartments can be varied and altered in the manner common to load bearing backpacks in the prior art, without substantially altering the intent or scope of the invention.

The advantages of this invention over the prior art arise from the fact that this backpack is intended to be of full and simultaneous use both as a cargo carrying backpack, and as a device for safely, efficiently, comfortably, and conveniently carrying a long gun. Furthermore, it is intended to be of use to one who is actively engaged in hiking while hunting, thereby leaving both hands, at least one of which would otherwise be holding or stabilizing a gun, free to assist in balance, climbing, holding away branches, and the like. The present invention offers the further advantage of providing easy and rapid access to the user's firearm. When it is necessary, there is minimum delay in having the gun unsheathed and moved to a firing position. Furthermore this action can be accomplished without removing the backpack from one's back. Lastly, by enclosing the majority of the firearm in a protective envelope and housing it aft of one's shoulders, there will be improvements in the protection of the firearm, and safety advantages in having the trigger, gun safety, and firing mechanism enclosed while one is traveling through and about protruding branches and the like.

It is presented that one reason that examples similar to this invention are not found in the prior art is because the mechanical and physical proportions of the present invention are not obvious. The present invention offers a dual utility backpack, which serves all of the functions of a standard backpack and has the added benefits and conveniences resulting from the careful incorporation of a gun scabbard. It can be seen that the present invention is an entirely unique, new, and useful departure from all that has been accomplished in the prior art.

DETAILED DESCRIPTION OF THE INVENTION

Figure 1:
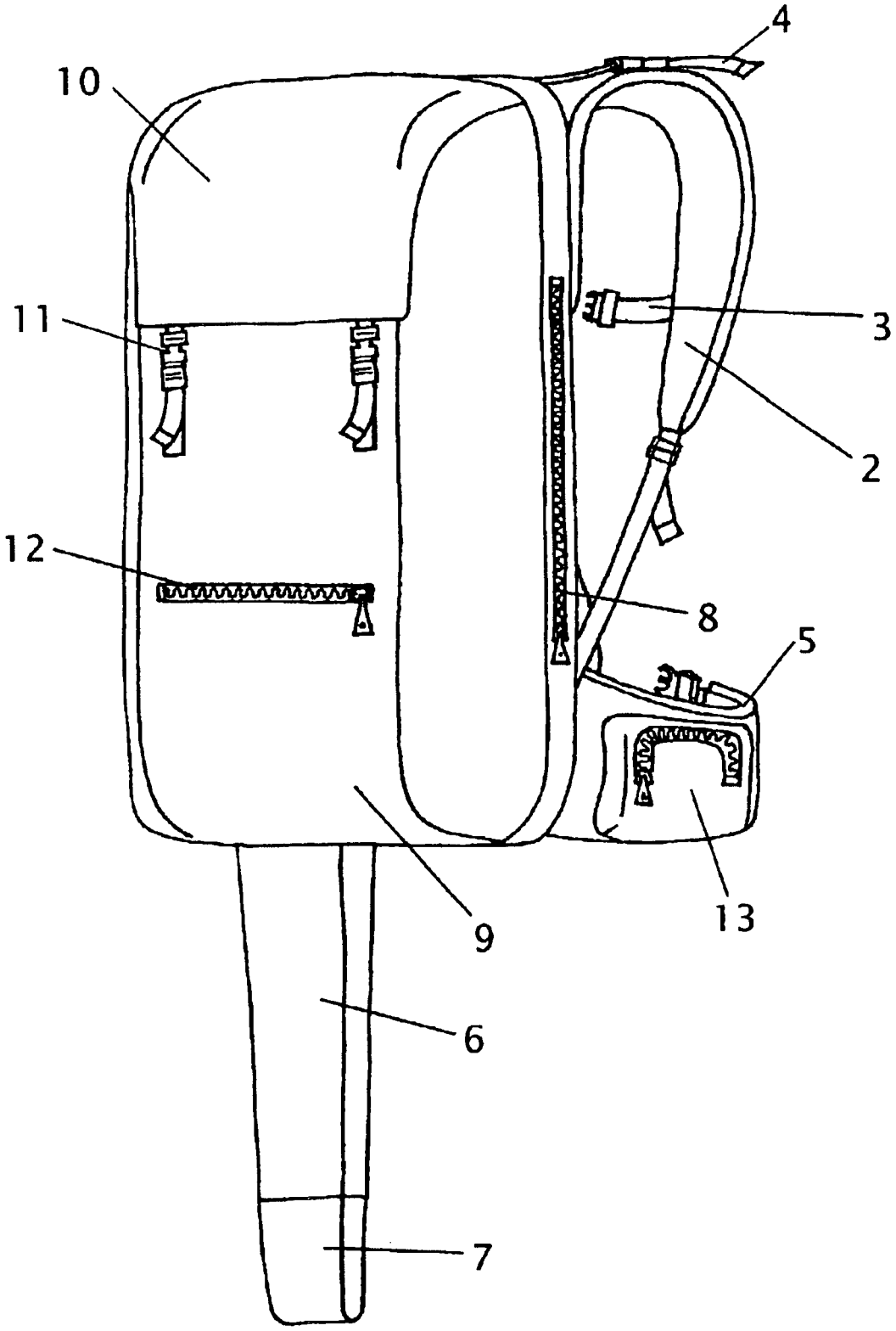
FIG. 1 is a right front quarter perspective view of a preferred embodiment of the invention.
Figure 2:
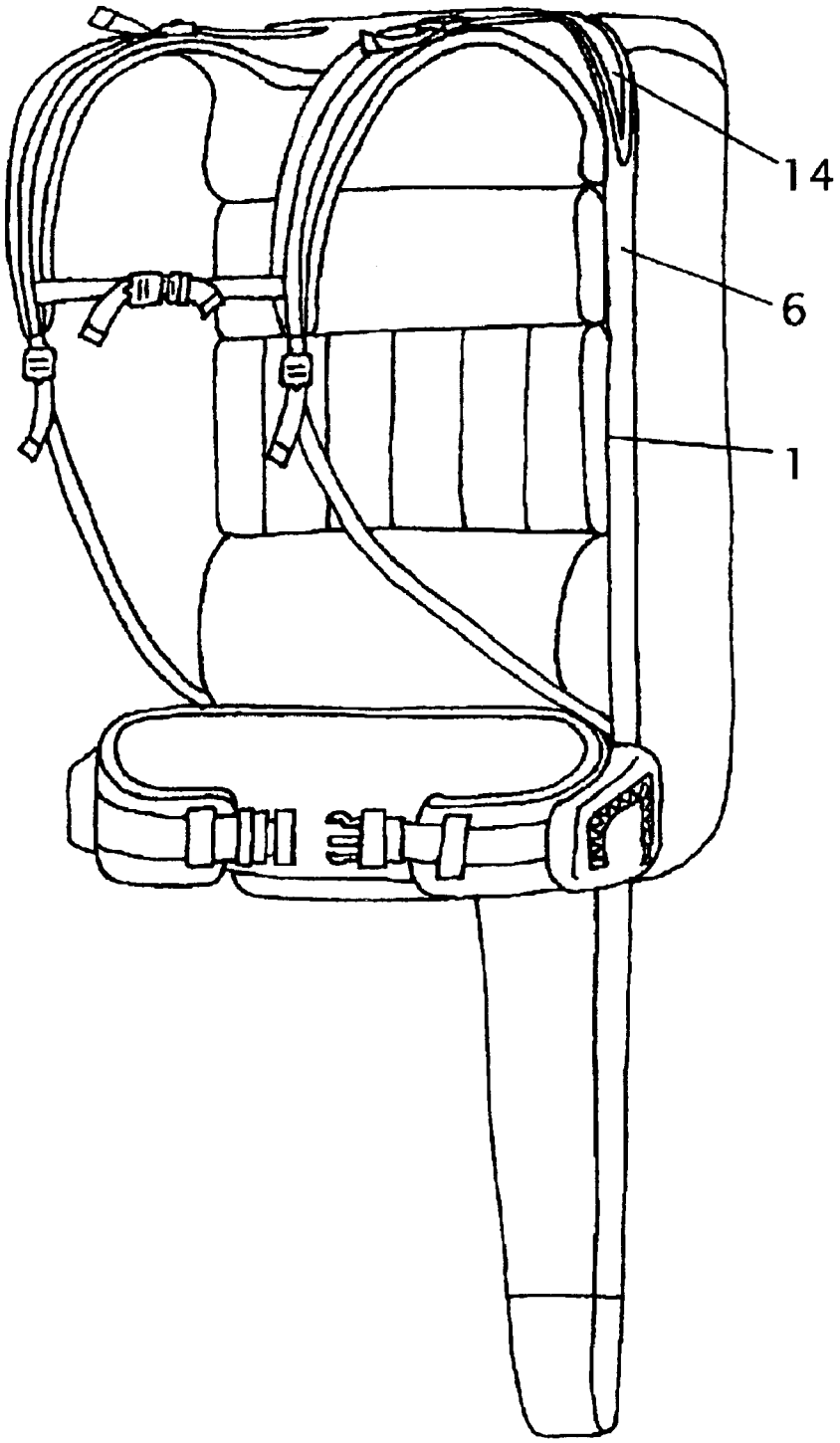
FIG. 2 is a left rear quarter perspective view of a preferred embodiment of the invention.
Figure 5:
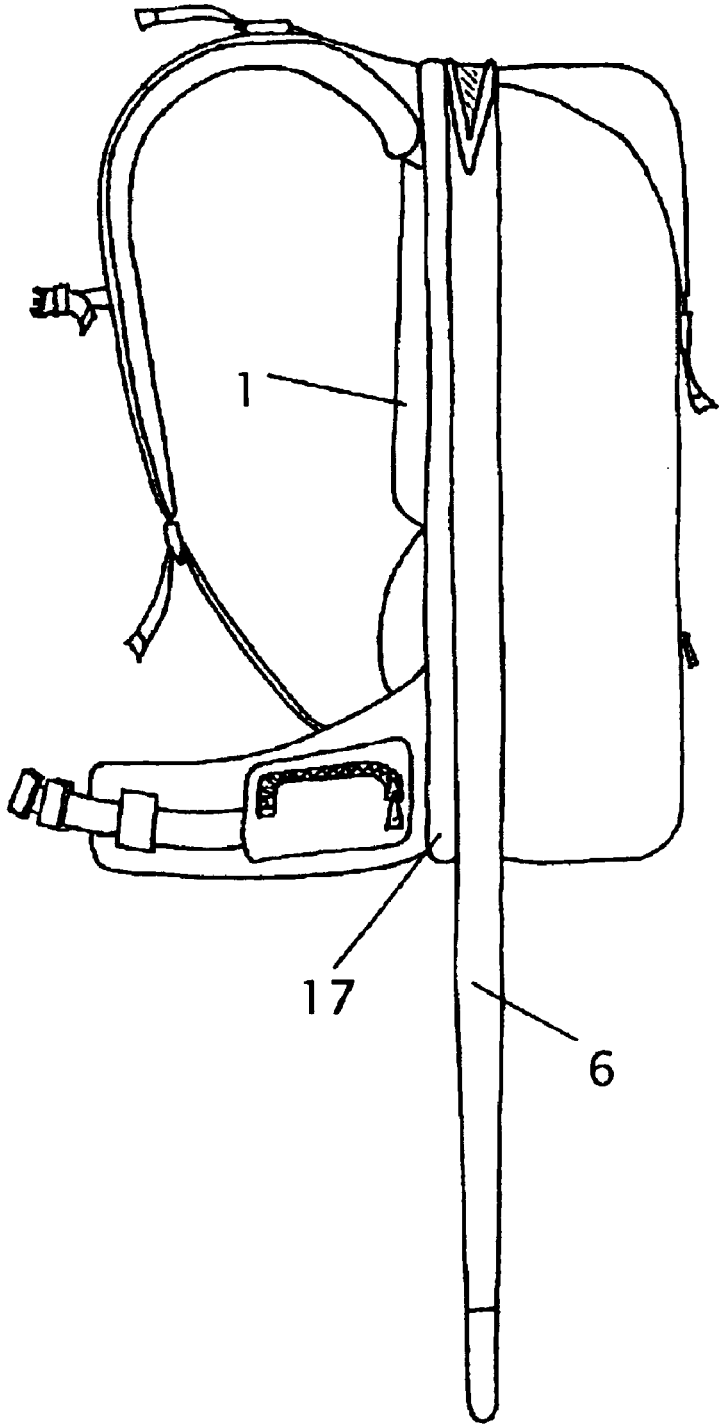
FIG. 5 is a left side profile view of the invention.

In accordance with the present invention, a backpack is provided, which is similar in styling to other backpacks designed for outdoor use, which is durable, and which has a scabbard sized for the stowage of a long gun firearm incorporated into its structure. As shown in FIG. 1, it is similar in appearance to conventional backpacks of the prior art, with the exception that the gun scabbard 6 extends below the bottom extent of the main structure. In particular, the backpack of the present invention includes a main panel 1, generally rectangular in shape, with a front side, a back side, two edges, a top, and a bottom, which in a preferred embodiment is padded in the areas in which it will contact a wearer's back, such padding being well known and commonly used in the prior art. Two shoulder straps 2 are provided, which in a preferred embodiment are padded such as is common with prior art backpacks designed for carriage of heavier loads. These may be provided with an adjustable chest strap 3, which is a feature common to load bearing backpacks of the prior art and facilitates lateral adjustment of said shoulder straps. Likewise, adjustable straps 4 extending from the top region of the shoulder strap 2 to the top region of the main panel 1 may be provided in order to provide the user a means of further adjusting the way in which the load of the backpack is borne upon one's back. The positioning of these shoulder straps on the main panel of the backpack is important. As shown in FIG. 5, the strap should be fashioned and attached such that the inner side of the arc described by the top of the strap where it will pass over the wearer's shoulders is approximately level with the top of the main panel 1 and the top of the scabbard 6.

In the preferred embodiment, a waist strap 5 is provided in order to transfer a portion of the load of the backpack to the user's hips, as is common with load bearing backpacks in the prior art. This waist belt is similar to the best waist belts available to the art, with a sandwich construction of heavy nylon or like fabric which is foam filled, and ideally should be wider nearest the main panel of the backpack, and which should taper as it extends forward around the wearer's hips or waist, toward a releasable and adjustable clasp, which again is common to the art.

Figure 3:
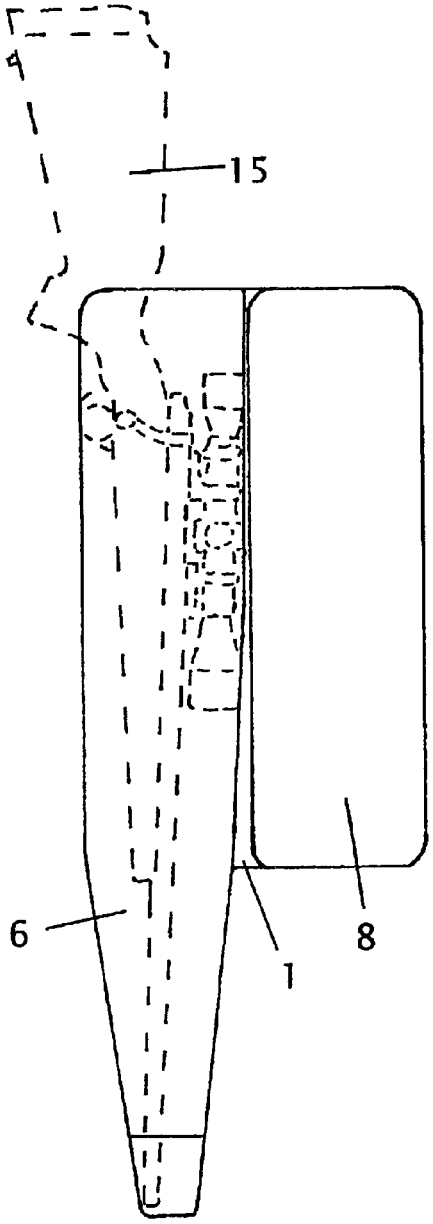
FIG. 3 is a sectional frontal plan view, showing the approximate storage volume relationship of a rifle in the scabbard, plus the adjacent area in the first described storage compartment, as well as the positioning of a rifle in a preferred embodiment.
Figure 4:
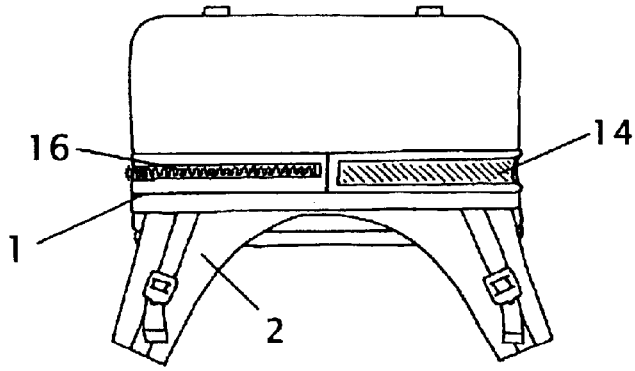
FIG. 4 is a top view of the invention.

The storage containers of the invention are of two varieties. Firstly, a gun scabbard 6 is provided, the orientation of which is best seen in FIGS. 3, 4, and 5. It may be laterally offset to one side or the other as shown in FIG. 3, which will place a gun that is being carried in closer proximity to one or the other of the user's arms, or it may be centrally located, with storage containers flanking it on both sides. As is common with gun scabbards, which are known and widely used, the scabbard provided in the present invention is a long, tapered receptacle with an interior space sized such that it will stow a variety of firearms, including scoped rifles 15, rifles without scopes, shotguns, and the like. This said scabbard can be constructed of many suitable materials that are known to the prior art of gun cases and scabbards, and in the preferred embodiment is fixedly attached to the front side of the main panel 1 of the backpack. In an alternative embodiment, this scabbard may be removably attached in the same location with a system of releasable clips, or zippers, or the like. The properties of the scabbard necessary to the function of the present invention are that it preferably should be of a semi-rigid, yet still pliable construction. This can be achieved by making each of its panels of two layers of a heavy-duty nylon type fabric, with a thin layer of dense closed-cell foam sandwiched between the layers. On one or more panels, preferably the narrower side panels, additional stiffness may be achieved by inserting a thin plastic batten between the nylon layers, or by sewing heavy nylon webbing to the outer layer. In order to fit symmetrically within the interior structure of a larger backpack, this scabbard will preferably be of a four-sided construction with an open top 14 as shown in FIG. 4. This open top may have a v-shaped slot extending down the outer side panel, thus permitting some flexibility to the overall structure. This is desirable due to the irregular shape of typical long guns, and further provides a shaped slot where the pistol grip of a rifle would be snugly held. An alternative three sided scabbard of the sort widely used elsewhere may be suitable. Ideally, a protective cover 7, made of leather or like material, is provided for the end of the scabbard where it may come into contact with obstacles the user is passing over.

The second type of storage container is made of nylon fabric or like material, is generally six sided, and sewn together to form an interior volume of space in a fashion that is common to the prior art. In a preferred embodiment, there will be more than one of these containers, of varying sizes and shapes, arranged so as to efficiently fill all of the available storage space around and about the aforementioned scabbard. These storage containers, devised for the purpose of carrying sundry cargo, will each have at least one aperture with a selectively releasable closure. The present embodiment shows a first storage compartment 8 positioned next to the gun scabbard 6. This compartment fills approximately the same volume of space adjacent to the main panel 1 as the gun scabbard, and the two are of like thickness. This thinner compartment may be sized to stow a water bladder, first aid supplies, or like objects which can best be stored in a thin compartment. As in FIG. 4, an opening 16 near the top may be more suitable if this container is meant to carry a water bladder. The present preferred embodiment also discloses a larger storage container 9, which is similar to storage containers common to the prior art, and ideally is constructed of nylon fabric or like material. It includes a top flap 10 with adjustable and selectively releasable closures 11, plus a zippered aperture 12 for access to the lower regions of the container. Two small storage containers 13 are added to the waist belt. It is noted that an alternative embodiment may be useful, wherein the large outer storage compartment 9 is not attached, and the first storage compartment 8 is made to be of a larger volume such that it offers the storage volume of typical daypacks, and that this embodiment is encompassed within the scope of the present invention.

As shown in FIG. 5, it may be desirable to provide an intervening structure 17 between the main panel 1 of the backpack and the various storage containers. This structure can serve to add additional stiffness and overall strength to the backpack, and would generally have similar construction to standard external frames of aluminum tubing or the like, which are common to the prior art.

The illustrations and the present description of the invention are illustrative only, for purposes of explaining and disclosing the invention. Since numerous modifications and changes will readily occur to those skilled in the art, it is not desired to limit the invention to the exact construction shown and described, and accordingly all modifications and equivalents may be regarded as falling within the scope of the invention. Other forms that employ the present invention and serve the purposes described herein are meant to be encompassed by this disclosure.

I claim:

1. A backpack comprising, in combination:

a main panel, generally rectangular in shape, having a top, a bottom, two side edges, a front side, and a rear side;

a pair of shoulder straps symmetrically mounted, vertically oriented, and fixedly attached proximal top rear side of said main panel, with the other end of each being fixedly attached proximal bottom rear side of said main panel;

a gun scabbard, fixedly attached to the front side of said main panel, said scabbard having a generally tapered and elongated shape, with an interior space sized suitably for the storage of long rifle or shotgun type firearms, and having an open top for the insertion and extraction of said firearms, but otherwise describing a fully enclosed space;

a storage container fixedly attached to the front side of said main panel, said storage container having a front panel, a rear panel, two side panels, a top panel, and a bottom panel, fixedly attached to one another so as to form a container with an interior space, this container having an access aperture which is fitted with a zipper or some such similar selectively releasable device.

2. The backpack of claim 1 wherein additional storage containers may be either fixedly or removably attached in such manner as to overlay said scabbard and said storage container.

3. The backpack of claim 2 wherein all said storage containers may be further internally subdivided into various and separate cells, each with its separate access aperture and selectively releasable mechanism for closure.

4. The backpack of claim 1 wherein said scabbard is positioned in an approximately vertical orientation, with the top edge of its rear panel proximate top edge of said main panel of the backpack.

5. The backpack of claim 1 wherein said scabbard is positioned with its upper-most edge in relation to the said straps of said backpack such that when the backpack is worn on a user's shoulders, the upper-most edge of the scabbard is approximately level with the tops of the user's shoulders.

6. The backpack of claim 1 wherein said shoulder straps are sized and positioned in such a way that when said backpack is being worn on a user's back, the top edge of said main panel is approximately on the level with the top of the user's shoulders.

7. The backpack of claim 1 with an added waist belt strap, horizontally oriented and fixedly attached to the rear side of said main panel proximate bottom edge of said main panel.

8. The backpack of claim 1 wherein said scabbard is removably attached to said backpack.

9. The backpack of claim 1 fitted with an external rigid frame, of aluminum tubing or like construction, intervening between the described main panel and said shoulder straps, and either fixedly or removably attached to both of these.

* * * * *